US005409553A

United States Patent [19]

Sagiyama et al.

[11] Patent Number: 5,409,553

[45] Date of Patent: Apr. 25, 1995

[54] PROCESS FOR MANUFACTURING GALVANNEALED STEEL SHEETS HAVING HIGH PRESS-FORMABILITY AND ANTI-POWDERING PROPERTY

[75] Inventors: Masaru Sagiyama; Masaki Abe; Junichi Inagaki; Akira Hiraya; Masaya Morita, all of Tokyo, Japan

[73] Assignee: NKK Corporation, Tokyo, Japan

[21] Appl. No.: 920,596

[22] PCT Filed: Dec. 27, 1991

[86] PCT No.: PCT/JP91/01802

§ 371 Date: Aug. 26, 1992

§ 102(e) Date: Aug. 26, 1992

[87] PCT Pub. No.: WO92/12271

PCT Pub. Date: Jul. 23, 1992

[30] Foreign Application Priority Data

Dec. 29, 1990 [JP] Japan ..... 2-415800

[51] Int. Cl.[6] ..... C21D 1/78; C23C 2/06

[52] U.S. Cl. ..... 148/516; 148/500; 148/503; 148/526; 148/533; 427/433; 428/659

[58] Field of Search ..... 148/516, 526, 533, 500, 148/503; 428/659; 427/383.9, 433

[56] References Cited

U.S. PATENT DOCUMENTS 5,049,453 9/1991 Suemitsu et al. ..... 148/533
5,074,924 12/1991 Ushioda et al. ..... 148/533

FOREIGN PATENT DOCUMENTS 52-48524 4/1977 Japan .
62-205262 9/1987 Japan .
63-157847 6/1988 Japan .

*Primary Examiner*—Michael Lewis
*Assistant Examiner*—Robert R. Koehler
*Attorney, Agent, or Firm*—Nields & Lemack

[57] ABSTRACT

It is an object to provide a process for manufacturing galvannealed steel sheets having high anti-powdering property as required when they are press formed, and stabilized frictional properties in a coil. Steel sheets are plated in a bath having a low aluminum content, while they have, when entering the bath, a low temperature as defined in relation to the aluminum content of the bath, so that an alloying reaction may be prevented. Then, the sheets are heated for alloying in a high-frequency induction heating furnace so that the sheets leaving the furnace may have a temperature of from over 495° C. to 520° C. to yield galvannealed consisting mainly of a $\delta_1$ phase. An iron or iron-alloy top coating having an appropriate iron content can be applied onto the plated steel surface to improve its paintability.

2 Claims, 1 Drawing Sheet

PROCESS FOR MANUFACTURING GALVANNEALED STEEL SHEETS HAVING HIGH PRESS-FORMABILITY AND ANTI-POWDERING PROPERTY

TECHNICAL FIELD

This invention relates to a process for manufacturing galvannealed steel sheets which are used for making automobile bodies and parts, etc., and particularly which exhibit excellent anti-powdering property when press formed, and stable frictional properties in a coil.

BACKGROUND ART

There has recently been an increasing demand for galvannealed steel sheets as the rust-proof steel sheets for automobiles, since they exhibit high corrosion resistance and weldability when painted. The latest tendency has been toward sheets having a heavier c/w to ensure high corrosion resistance.

These galvanized steel sheets are required to have excellent press-formability and exhibit excellent anti-powdering property when press formed. These requirements have lately been becoming more stringent, and the increasing coating weight has been creating a big problem in the maintenance of, above all, excellent anti-powdering property.

There is known a process which comprises heating galvanized steel sheets rapidly to cause the alloying of a part of coating, and batch annealing them to improve their anti-powdering property. This process is effective in achieving an improved anti-powdering property, but has the drawback of being expensive.

Japanese Laid-Open Patent Application No. Hei 1-279738 discloses a process for achieving an improved anti-powdering property in line. According to its disclosure, steel sheets are plated in a bath containing 0.04 to 0.12% Al, are heated to a temperature of at least 470° C. rapidly within two seconds to undergo alloying, and are cooled to a temperature not exceeding 420° C. rapidly within two seconds, whereby galvannealed steel sheets consisting mainly of a $\delta_1$ phase are manufactured.

Due to the relatively high temperature which the process employs for the alloying treatment, however, it is very likely that alloying may proceed so rapidly that the growth of a thick $\Gamma$ phase may result in a low anti-powdering property. Although Japanese Laid-Open Patent Application No. Hei 1-279738 proposes rapid cooling within two seconds from the temperature range in which alloying is effected, to the temperature range not exceeding 420° C. to prevent excessive alloying, a proper alloying pattern varies with the coating weight and the line speed, and the use of the process, therefore, calls for the provision of a multiplicity of sources of heating and cooling mediums along a line and thereby brings about an increase in the cost of equipment.

Moreover, a direct gas-fired alloying furnace which is usually employed is likely to have a temperature variation along the width and length of a steel strip, and such temperature variation makes difficult the strict control of the coating structure as hereinabove stated and results in the formation of a coating having excessively alloyed portions or containing a residual $\zeta$ phase. The resulting plated steel sheet lacks uniformity in the amount of its $\delta_1$ phase and therefore in its anti-powdering property. The amount of the $\zeta$ phase has so close a bearing on the frictional properties that those portions of the plated steel sheet which contain the residual $\zeta$ phase have a higher frictional coefficient and are, therefore, lower in press formability.

DISCLOSURE OF THE INVENTION

In view of the problems of the prior art as hereinabove pointed out, we, the inventors of this invention, have studied an alloying reaction on a galvanized steel sheet, and found the following:

(1) The $\zeta$ phase is formed by a reaction at or below 495° C., and is not formed at any temperature exceeding it; and (2) Therefore, it is possible to form a coating consisting mainly of a $\delta_1$ phase if the principal reaction (the reaction which causes a molten zinc phase to disappear) is caused to take place at a temperature exceeding 495° C., followed by cooling. FIGS. 1 and 2 show by way of example phase changes resulting from isothermal alloying reactions on galvanized steel sheets at 450° C. and 500° C., respectively. While the alloying at 450° C. results in the formation of a $\zeta$ phase, the alloying at 500° C. hardly brings about any $\zeta$ phase, but forms a coating consisting mainly of a $\delta_1$ phase.

The use of such a relatively high temperature for alloying is, however, likely to result in an excessively alloyed coating which is low in anti-powdering property, as hereinabove stated. Moreover, a usual direct-fired alloying furnace is difficult to employ to achieve combustion which is uniform from the standpoints of both time and place, and is likely to cause uneven firing. Such uneven firing forms an alloy layer lacking uniformity, and results only in a product lacking uniformity in anti-powdering property, frictional properties, etc. depending upon the portions of the steel strip.

Under these circumstances, we have tried to explore a process which can always reliably be employed to achieve both anti-powdering property and press formability which are satisfactorily excellent, and have discovered the following:

(1) It is possible to obtain a coating in which an alloy layer consisting mainly of a $\delta_1$ phase is formed uniformly along the width and length of a strip, if any alloying reaction (formation of a $\zeta$ phase) in a zinc bath is inhibited, and if the subsequent alloying treatment is carried out by employing a high-frequency induction heating furnace;

(2) The resulting alloyed coating exhibits excellent anti-powdering property and press formability owing to the alloying reaction taking place uniformly not only macroscopically as hereinabove stated, but also microscopically;

(3) It is possible to achieve a strict coating control if the conditions of the bath and the temperature of the strip leaving the high-frequency induction heating furnace are appropriately specified, or more specifically, it is possible to control the alloying reaction (formation of a $\zeta$ phase) in the bath adequately if the bath has a low aluminum content and if the strip entering the bath has a relatively low temperature as defined in relation to the aluminum content of the bath, and it is possible to obtain the coating as described at (1) and (2) above if the alloying treatment for the galvanized strip in the high-frequency induction heating furnace is so performed that the strip leaving the furnace may have a temperature of from over 495° C. to 520° C.; and (4) The alloyed coating exhibits good paintability at a small coating weight if it is covered with an iron or iron-alloy top coating.

This invention is based on the foregoing discovery, and consists essentially in:

[1] A process for manufacturing galvannealed steel sheets having excellent press-formability and anti-powdering property by galvanizing a steel strip in a zinc bath containing aluminum, the balance of its composition being zinc and unavoidable impurities, controlling its coating weight, and subjecting the strip to alloying treatment in a heating furnace so that its coating may have an iron content of 8 to 12%, characterized in that the bath has an aluminum content of at least 0.05%, but less than 0.13%, and a temperature not exceeding 460° C., that the strip has, when entering the bath, a temperature satisfying the following relationship:

$$437.5\times[Al\%]+428>T\geqq437.5\times[Al\%]+408$$

where

[Al%]: the aluminum content (%) of the bath;

T: the temperature (°C.) of the strip entering the bath, so that any reaction causing the alloying of iron and zinc may be prevented from occurring in the bath, and that the furnace is a high-frequency induction furnace in which the strip is heated so as to have a temperature of from over 495° C. to 520° C. when leaving the furnace, the strip being held at that temperature for a predetermined length of time, and cooled; and

[2] A process for manufacturing galvannealed steel sheets having excellent press-formability and anti-powdering property by galvanizing a steel strip in a zinc bath containing aluminum, the balance of its composition being zinc and unavoidable impurities, controlling its coating weight, and subjecting the strip to alloying treatment in a heating furnace so that its coating may have an iron content of 8 to 12%, characterized in that the bath has an aluminum content of at least 0.05%, but less than 0.13%, and a temperature not exceeding 460° C., that the strip has, when entering the bath, a temperature satisfying the following relationship:

$$437.5\times[Al\%]+428>T\geqq437.5\times[Al\%]+408$$

where

[Al%]: the aluminum content (%) of the bath;

T: the temperature (°C.) of the strip entering the bath, so that any reaction causing the alloying of iron and zinc may be prevented from occurring in the bath, and that the furnace is a high-frequency induction furnace in which the strip is heated so as to have a temperature of from over 495° C. to 520° C. when leaving the furnace, the strip being held at that temperature for a predetermined length of time, and cooled, and that the strip is plated with a top coating having an iron content of at least 50% and coating weight of at least 2 g/m$^2$.

DETAILED DESCRIPTION OF THE INVENTION

Figure 1:
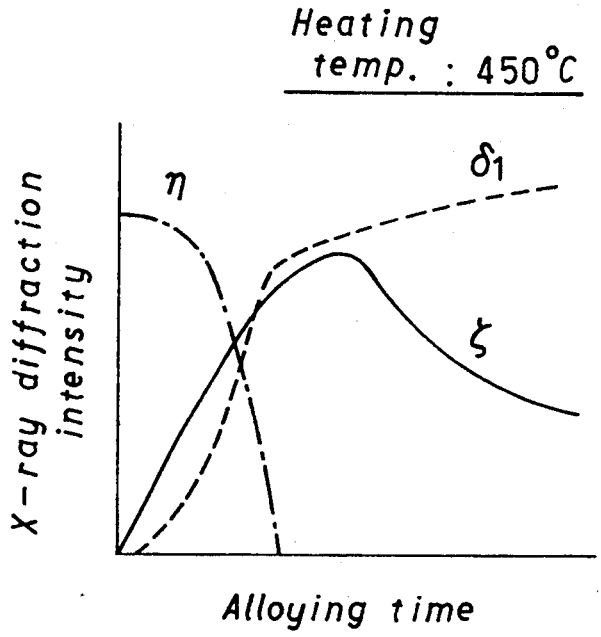
FIG. 1 shows by way of example the phase changes occurring in galvannealed steel sheets as a result of the isothermal reaction at 450° C.
Figure 2:
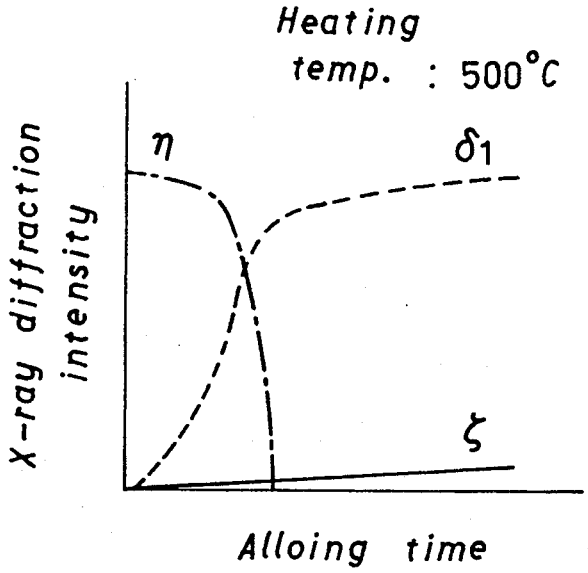
FIG. 2 shows by way of example the phase changes occurring in galvannealed steel sheets as a result of the isothermal alloying reaction at 500° C.

The alloying treatment of galvanized steel sheets by high-frequency induction heating is known, as described in, for example, Japanese Patent Publication No. Sho 60-289 and Japanese Laid-Open Patent Application No. Hei 2-37425. The arts disclosed therein are, however, nothing but the use of high-frequency induction heating as a means for rapid heating.

On the other hand, this invention is based on the discovery of the fact that, if the alloying reaction in the bath is inhibited as far as possible, and if the coating in which alloying has been inhibited is subjected to alloying treatment by high-frequency induction heating under specific conditions, it is possible to form an alloy layer hardly having any Γ phase, but consisting mainly of a $\delta_1$ phase uniformly on a steel strip and produce a plated steel strip having an overally excellent anti-powdering property due to the microscopic uniformity of its coating structure, as well as high press-formability.

It is presumably for the reasons as will hereunder be set forth that the process of this invention can manufacture plated steel sheets having outstanding properties as hereinabove stated.

In the first place, the use of high-frequency induction heating for the alloying treatment enables the direct heating of the strip and particularly of its surface contacting the coating which, as opposed to gas heating, allows the reaction of iron and zinc to occur rapidly and uniformly on the surface of any strip portion and thereby form a layer not having any excessively alloyed portion or any residual ζ phase, but exhibiting uniform anti-powdering property and press formability.

In the second place, the direct heating of the strip as hereinabove stated apparently brings about an even microscopically uniform alloying reaction. The conventional alloying treatment by gas heating is likely to lack heating uniformity and result in an alloying reaction which microscopically lacks uniformity, since heat is applied from the outside of the coating. The grain boundary is particularly high in reactivity and is, therefore, likely to undergo the so-called outburst reaction forming an outburst structure which causes the growth of a Γ phase lowering the anti-powdering property of the coating. On the other hand, high-frequency induction heating, which enables the direct heating of the strip, enables a substantially uniform alloying reaction and facilitates the diffusion of oxides on the strip and an alloying inhibitor ($Fe_2Al_5$) formed in the bath, thereby enabling the formation of an even microscopically uniform alloy layer.

In the third place, high-frequency induction heating allows only a limited length of time for the growth of the Γ phase, as it enables the rapid alloying of the coating. This invention can greatly restrict the overall formation of the Γ phase, as it also inhibits the formation of the Γ phase in the bath. This apparently contributes greatly to achieving an improved anti-powdering property.

In the fourth place, high-frequency induction heating has the advantage of enabling the uniform heating of the strip along its width and length, and thereby the strict control of the temperature of the strip leaving the heating furnace. Moreover, there can hardly occur any excessive alloying even without any special cooling, since there is no heated and rising atmosphere gas (due to the draft effect) as in any heating apparatus employing an atmosphere gas, such as a gas-fired furnace.

Description will now be made of the essential features of this invention and the reasons for the limitations employed to define it.

According to this invention, the aluminum content of a zinc bath, the temperature of a steel strip entering the bath and the bath temperature are so specified as to prevent any alloying reaction in the bath as far as possible. According to one of the salient features of this invention, the bath has a low aluminum content and the strip entering the bath has a relatively low temperature as defined in relation to the aluminum content of the bath, so that any alloying reaction in the bath may be prevented.

While it is necessary to plate in a bath having a low aluminum content a strip having a low temperature when entering the bath in order to prevent any alloying reaction (formation of a $\zeta$ phase) in the bath, $Fe_2Al_5$ does not effectively prevent alloying in any bath having an aluminum content of less than 0.05%, but an outburst reaction takes place in the bath and brings about a inferior anti-powdering property. Therefore, it is necessary for the bath to have an aluminum content of at least 0.05%. If the bath has an aluminum content of 0.13% or more, however, the excessive inhibition of the-alloying reaction of iron and zinc in the bath calls for an abrupt alloying reaction during the subsequent alloying treatment and such an abrupt alloying reaction brings about an inferior anti-powdering property. Therefore, it is necessary for the bath to have an aluminum content of less than 0.13%.

The temperature of the strip entering the bath is required to satisfy the following relationship to the aluminum content of the bath:

$$437.5\times[Al\%]+428>T\geqq437.5\times[Al\%]+408$$

where

[Al%]:the aluminum content (%) of the bath;

T:the temperature (°C.) of the strip entering the bath.

If the temperature of the strip entering the bath exceeds the upper limit of the range as defined above, the alloying reaction takes place in the bath and forms a $\zeta$ phase, thereby disabling the formation of an alloy layer consisting mainly of a $\delta_1$ phase as intended by this invention. If the temperature is lower than the lower limit, the formation of $Fe_2Al_5$ in a way lacking uniformity brings about a local alloying reaction resulting in a lower anti-powdering property.

The bath is required to have a temperature not exceeding 460° C., since a higher temperature promotes an alloying reaction in the bath. Moreover, too high a bath temperature brings about problems including the formation of dross by the erosion of structural members immersed in the bath.

The strip which has been galvanized is heated for alloying in a high-frequency induction heating furnace. The heating by a high-frequency induction heating furnace is a salient feature of this invention other than the bath conditions as hereinabove set forth, since no alloyed coating as intended by this invention can be obtained by the conventional gas heating as hereinbefore stated. The allowing treatment is carried out by heating the strip so that the strip leaving the furnace may have a temperature of from over 495° C. to 520° C., holding it for a predetermined length of time, and cooling it. Heating at a temperature exceeding 495° C. is necessary to form a $\delta_1$ phase, as hereinabove stated, so that the coating which has been prevented from alloying in the bath is alloyed to form an alloy layer consisting mainly of a $\delta_1$ phase. The heating temperature has, however, an upper limit of 520° C., since heating at a temperature exceeding 520° C. forms a $\Gamma$ phase resulting in a inferior anti-powdering property. The strip temperature is controlled at the exit of the high-frequency induction heating furnace, since in that area, the strip reaches the maximum temperature in an alloying heat cycle. The control of the strip temperature at the exit of the furnace enables an alloying reaction at that temperature, since the rate of growth of the alloy layer reaches the maximum in that area.

This invention is intended for manufacturing galvannealed steel sheets having a coating containing 8 to 12% of iron. A coating containing more than 12% of iron is hard, and low in anti-powdering property. If alloying is continued beyond the exit of the high-frequency induction heating furnace, a diffusion reaction in a solid results in the formation of a coating having a higher iron content. A coating having an iron content of less than 8% is undesirable, since an $\eta$ phase (pure zinc) remains on the surface of the coating and causes flaking when the strip is press formed.

Although it has hitherto been believed that the iron content of a coating has a decisive bearing on its structure, the appropriately selected bath conditions and the alloying treatment by high-frequency induction heating, as proposed by this invention, enable the formation of a specific coating structure as intended by this invention, irrespective of its iron content.

The alloyed coating obtained as hereinabove described is composed of a uniform $\delta_1$ phase on its surface and a very thin $\Gamma$ phase underlying it.

An iron or iron-alloy top coating having an iron content of at least 50% and a coating weight of at least 2 g/m$^2$ can be applied onto the alloyed coating to improve its paintability. A galvannealed steel sheet is likely to develop during electrodeposition a defect called cratering which exerts an adverse effect on the appearance of a finally painted surface. The top coating prevents the occurrence of any such painting defect and improves the paintability of the sheet. The top coating preferably consists solely of an $\alpha$ phase to ensure improved paintability. An iron or iron-alloy coating having an iron content of at least about 50% consists solely of an $\alpha$ phase.

No top coating weight that is less than 2 g/m$^2$ is satisfactory for improving paintability. Although the top coating weight has no particular upper limit, it is preferable from an economical standpoint to set an upper limit of 5 g/m$^2$. The high-frequency induction heating of the galvanized strip which is followed by electroplating the top coating therefor as proposed by this invention, does not cause any oxidation of the coating surface, but enables the appropriate application of the top coating onto the alloyed coating surface, and thereby a reduction in top coating weight, as compared with what is required on a coating alloyed by gas heating.

EXAMPLES

Examples of this invention are shown in TABLES 1 to 4.

These examples were carried out by employing as starting materials cold rolled sheets of Al-killed steel (containing 0.03% C and 0.02% sol. Al) and Ti-containing IF steel (containing 0.0025% C, 0.04% sol. Al and 0.07% Ti), and galvanizing them, heating them and top coating a part of them, under the conditions shown in TABLES 1 and 2. The heating was gas or high-frequency induction heating. The anti-powdering property, press formability, and paintability of the galvannealed steel sheets which were obtained are shown in TABLES 3 and 4.

The temperature of the sheet entering the plating bath was its surface temperature as measured by a radiation pyrometer immediately before it entered the bath. The temperature of the sheet leaving the heating furnace was its surface temperature as measured by a radiation pyrometer at the discharge end of the furnace.

The aluminum content of the bath is the effective aluminum concentration as defined by the following equation:

[Effective Al concentration]=[Total Al concentration of bath]−[Iron concentration of bath]+0.03

The percentage of iron in the coating depends on the bath conditions, and the heating and cooling conditions. The cooling conditions vary the degree of alloying (% of Fe in the coating) and thereby affect its properties, though they hardly have any effect on the macroscopic or microscopic uniformity of the coating structure defining one of the salient features of this invention. Therefore, the examples were carried out by controlling the capacity of a cooling blower and the amount of mist to regulate the percentage of iron in the coating.

The following is a description of the methods which were employed for testing and evaluating the products for properties:

Amount of $\zeta$ phase in coatings on products:

The peak intensity, I $\zeta_{[421]}$, of the $\zeta$ phase at d=1.900 and the peak intensity, I $\delta_{1[249]}$, of the $\delta_1$ phase at d=1.990 were determined by the X-ray diffraction of the coating, and their ratio was calculated in accordance with the following equation as representing the amount of the $\zeta$ phase in the coating. $I_{BG}$ represents the background, and if Z/D does not exceed 20, there is substantially no $\zeta$ phase.

$$Z/D=(I\ \zeta_{[421]}-I_{BG})/(I\ \delta_{1[249]}-I_{BG})\times 100$$

Anti-powdering property

After each specimen had been coated with 1 g/m$^2$ of a rust-preventing oil (Nox Rust 530F of Parker Industries, Inc.), a draw bead test was conducted by employing a bead radius R of 0.5 mm, a holding load P of 500 kg and an indentation depth h of 4 mm. After a tape had been peeled off, the amount of powdering was calculated from a difference in weight of the specimen from its initial weight. Each of the values appearing in the tables is the average of a plurality of values as measured (5×5=25).

Maximum deviation of anti-powdering property along strip width

The anti-powdering property of each strip was measured at five points along its length and at five points along its width (both edges, midway between each edge and the center, and the center) in a region having stabilized operating conditions. The difference between the maximum and minimum values was taken as the maximum deviation.

Coefficient of friction

After each specimen had been coated with 1 g/m$^2$ of rust-preventing oil (Nox Rust 530F of Parker Industries, Inc.), an indenter made of tool steel SKD 11 was held against the specimen under a load of 400 kg and it was drawn at a speed of 1 m/min. The ratio of the drawing load and the holding load was taken as the frictional coefficient. Each of the values appearing in the tables is the average of a plurality of values as measured (5×5=25).

Maximum deviation of coefficient of friction along strip width

The coefficient of friction was measured at the same points as those at which the anti-powdering property had been measured, and the difference between the maximum and minimum values was taken as the maximum deviation.

In Comparative Examples 1 and 2, the frictional properties were bad due to the formation of a $\zeta$ phase in the bath, as the temperatures of the strips entering the bath were too high. The product of Comparative Example 3 was bad in anti-powdering property due to the microscopically non-uniform alloying as a result of the non-uniform formation of $Fe_2Al_5$ in the bath, as the temperature of the strip entering the bath was low. The product of Comparative Example 4 was bad in frictional properties due to the formation of a $\zeta$ phase in the coating, as the temperature achieved by high-frequency induction heating was too low. The products-of. Comparative Examples 5 and 10 were bad in anti-powdering property due to the formation of a thick $\Gamma$ phase, as the temperatures achieved by high-frequency induction heating were too high.

Gas heating was employed in Comparative Examples 6 to 8. The product of Comparative Example 6, in which a relatively high temperature was employed, was bad in anti-powdering property due to the partial formation of a $\Gamma$ phase as a result of uneven firing, and showed frictional properties varying along the strip width. The products of Comparative Examples 7 and 8, in which lower temperatures were employed, were bad in both anti-powdering and frictional properties due to the partially remaining $\zeta$ phase as a result of uneven firing, and showed greatly varying results along the strip width.

Comparative Example 9 was carried out to enable comparison with respect to the top coating weight.

TABLE 1

| | | Undercoat plating conditions | | | | | | | | |
|---|---|---|---|---|---|---|---|---|---|---|
| No. | *1 Steel type | Temp. of strip entering bath (°C.) | Al content of bath (wt %) | Line speed (mpm) | Heating | Temp. of strip leaving the heating furnace (°C.) | Coating weight (g/m$^2$) | Fe content of the coating (wt %) | Top coating weight (g/m$^2$) | *2Amount of $\zeta$ phase in product (Z/D) |
| Invention's Example 1 | A | 468 | 0.117 | 100 | Inducting heating | 505 | 58.7 | 10.5 | — | 17.0 (none) |
| Invention's | A | 454 | 0.087 | 100 | Inducting | 507 | 59.2 | 10.2 | — | 16.2 (none) |

TABLE 1-continued

| No. | *1 Steel type | Undercoat plating conditions: Temp. of strip entering bath (°C.) | Al content of bath (wt %) | Line speed (mpm) | Heating | Temp. of strip leaving the heating furnace (°C.) | Coating weight (g/m²) | Fe content of the coating (wt %) | Top coating weight (g/m²) | *2Amount of ζ phase in product (Z/D) |
|---|---|---|---|---|---|---|---|---|---|---|
| Example 2 | | | | | heating | | | | | |
| Invention's Example 3 | A | 453 | 0.066 | 100 | Inducting heating | 506 | 58.3 | 10.7 | — | 15.8 (none) |
| Invention's Example 4 | A | 440 | 0.056 | 100 | Inducting heating | 505 | 58.9 | 10.5 | — | 16.7 (none) |
| Comparative Example 1 | A | 470 | 0.070 | 100 | Inducting heating | 510 | 60.1 | 10.3 | — | 32.1 |
| Comparative Example 2 | A | 482 | 0.100 | 100 | Inducting heating | 508 | 59.2 | 10.5 | — | 30.6 |
| Comparative Example 3 | A | 450 | 0.120 | 100 | Inducting heating | 505 | 59.4 | 10.2 | — | 18.1 (none) |
| Invention's Example 5 | A | 455 | 0.092 | 90 | Inducting heating | 515 | 65.2 | 9.8 | — | 19.3 (none) |
| Invention's Example 6 | A | 457 | 0.094 | 90 | Inducting heating | 500 | 64.8 | 9.9 | — | 18.7 (none) |
| Comparative Example 4 | A | 455 | 0.091 | 90 | Inducting heating | 490 | 64.2 | 10.0 | — | 28.5 |
| Comparative Example 5 | A | 456 | 0.095 | 90 | Inducting heating | 525 | 65.3 | 9.8 | — | 18.4 (none) |

*1Steel type A: Al-killed steel; Steel type B: Ti-containing IF steel
*2No ζ phase if Z/D is not more than 20

TABLE 2

| No. | *1 Steel type | Undercoat plating conditions: Temp. of strip entering bath (°C.) | Al content of bath (wt %) | Line speed (mpm) | Heating | Temp. of strip leaving the heating furnace (°C.) | Coating weight (g/m²) | Fe content of the coating (wt %) | Top coating weight (g/m²) | *2Amount of ζ phase in product (Z/D) |
|---|---|---|---|---|---|---|---|---|---|---|
| Invention's Example 7 | B | 474 | 0.122 | 100 | Inducting heating | 504 | 58.8 | 10.5 | — | 19.5 (none) |
| Invention's Example 8 | B | 475 | 0.122 | 100 | Inducting heating | 508 | 57.8 | 10.6 | — | 18.9 (none) |
| Invention's Example 9 | B | 474 | 0.120 | 100 | Inducting heating | 516 | 58.6 | 10.4 | — | 18.8 (none) |
| Comparative Example 6 | A | 460 | 0.063 | 90 | Gas heating | 515 | 60.1 | 11.2 | — | 19.3 (none) |
| Comparative Example 7 | A | 462 | 0.062 | 90 | Gas heating | 508 | 61.4 | 10.9 | — | 20.0 |
| Comparative Example 8 | A | 460 | 0.064 | 90 | Gas heating | 500 | 60.5 | 10.6 | — | 22.6 |
| Comparative Example 9 | A | 460 | 0.100 | 80 | Inducting heating | 505 | 55.5 | 9.8 | 0.8 | 17.2 (none) |
| Invention's Example 10 | A | 461 | 0.100 | 80 | Inducting heating | 507 | 56.1 | 9.9 | 2.2 | 16.8 (none) |
| Invention's Example 11 | A | 460 | 0.100 | 80 | Inducting heating | 506 | 55.9 | 9.8 | 3.5 | 17.0 (none) |
| Invention's Example 12 | A | 478 | 0.121 | 80 | Inducting heating | 506 | 50.2 | 10.0 | 2.5 | 17.0 (none) |
| Invention's Example 13 | A | 480 | 0.122 | 80 | Inducting heating | 515 | 52.1 | 10.3 | 2.7 | 17.2 (none) |
| Comparative Example 10 | A | 478 | 0.121 | 80 | Inducting heating | 530 | 50.7 | 10.7 | 2.8 | 17.0 (none) |

*1Steel type A: Al-killed steel; Steel type B: Ti-containing IF steel
*2No ζ phase if Z/D is not more than 20

TABLE 3

| No. | *1Anti-powdering property (g/m²) | *2Maximum deviation along strip width (g/m²) | *3Frictional coefficient | *4Maximum deviation along strip width | Remarks |
|---|---|---|---|---|---|
| Invention's Example 1 | 4.3 | 0.22 | 0.135 | 0.002 | |
| Invention's Example 2 | 4.0 | 0.20 | 0.133 | 0.002 | |
| Invention's Example 3 | 4.5 | 0.26 | 0.136 | 0.002 | |
| Invention's Example 4 | 4.5 | 0.23 | 0.139 | 0.003 | |
| Comparative Example 1 | 4.6 | 0.27 | 0.148 | 0.002 | ζ phase formed in the bath. |
| Comparative Example 2 | 4.7 | 0.28 | 0.145 | 0.003 | ζ phase formed in the bath. |
| Comparative Example 3 | 7.2 | 0.42 | 0.136 | 0.003 | The non-uniform formation of $Fe_2Al_5$ brought about microscopic non-uniformity and low anti-powdering property. |
| Invention's Example 5 | 5.8 | 0.28 | 0.138 | 0.002 | |

TABLE 3-continued

| No. | *1Anti-powdering property ($g/m^2$) | *2Maximum deviation along strip width ($g/m^2$) | *3Frictional coefficient | *4Maximum deviation along strip width | Remarks |
|---|---|---|---|---|---|
| Invention's Example 6 | 5.6 | 0.27 | 0.136 | 0.003 | |
| Comparative Example 4 | 4.9 | 0.25 | 0.145 | 0.006 | Because of the strip leaving temperature of high frequency induction heating farnace is high, ζ phase is formed. |
| Comparative Example 5 | 8.4 | 0.44 | 0.133 | 0.003 | Because of the strip leaving temperature of high frequency induction heating farnace is high, anti-powdering property is low. |

*1Good if it is not more than 6 $g/m^2$ (at a coating weight of 60 $g/m^2$)
*2Good if it is not more than 0.3 $g/m^2$
*3Good if it is not more than 0.14
*4Good if it is not more than 0.003

TABLE 4

| No. | *1Anti-powdering property ($g/m^2$) | *2Maximum deviation along strip width ($g/m^2$) | *3Frictional coefficient | *4Maximum deviation along strip width | Electrode position property | Remarks |
|---|---|---|---|---|---|---|
| Invention's Example 7 | 4.9 | 0.26 | 0.138 | 0.003 | — | |
| Invention's Example 8 | 5.4 | 0.28 | 0.136 | 0.002 | — | |
| Invention's Example 9 | 5.7 | 0.27 | 0.136 | 0.002 | — | |
| Comparative Example 6 | 10.7 | 1.17 | 0.132 | 0.008 | — | Uneven firing formed portions having thick Γ phases. |
| Comparative Example 7 | 8.1 | 0.88 | 0.142 | 0.009 | — | Uneven firing formed portions having residual ζ phase. |
| Comparative Example 8 | 6.8 | 0.80 | 0.145 | 0.012 | — | Uneven firing formed portions having residual ζ phase. |
| Comparative Example 9 | 4.2 | 0.25 | 0.138 | 0.004 | x | Because of less amount of the top coating, low electrodeposition property is formed. |
| Invention's Example 10 | 4.5 | 0.27 | 0.122 | 0.002 | ∘ | |
| Invention's Example 11 | 4.7 | 0.28 | 0.121 | 0.002 | ∘ | |
| Invention's Example 12 | 3.8 | 0.22 | 0.122 | 0.002 | ∘ | |
| Invention's Example 13 | 5.2 | 0.25 | 0.123 | 0.002 | ∘ | |
| Comparative Example 10 | 8.9 | 0.65 | 0.123 | 0.003 | ∘ | Because of the strip leaving temperature of high frequency induction heating farnace is high, anti-powdering property is low. |

*1Good if it is not more than 6 $g/m^2$ (at a coating weight of 60 $m^2$)
*2Good if it is not more than 0.3 $g/m^2$
*3Good if it is not more than 0.14 without top coating
0.13 with top coating
*4Good if it is not more than 0.003

What is claimed is:

1. A process for manufacturing galvannealed steel sheets having high press-formability and anti-powdering property, comprising:

providing a zinc plating bath having an aluminum content of at least 0.05 %, but less than 0.13 %, the balance of the bath composition being zinc and unavoidable impurities, said bath having a temperature not exceeding 460° C.;

prior to immersing a steel strip in said bath, setting the temperature of said steel strip by heat treatment satisfying the following relationship:

$$437.5\times[Al\%]+428>T\geqq437.5\times[Al\%]+408$$

where

[A1%]: the aluminum content (%) of said bath; and

T: the temperature (°C.) of said strip entering said bath, so that any reaction causing the alloying of iron and zinc may be prevented from occurring in said bath;

plating in said zinc plating bath said steel strip which was subjected to said heat treatment;

controlling the coating weight of a plating layer; and subjecting said coated strip to alloying treatment in a high-frequency induction furnace so that its coating may have an iron content of 8 to 12%, by heating said coated strip in said furnace so that said coated strip has a temperature of from over 495° C. to 520° C. when leaving said furnace, and cooling said coated strip.

2. A process for manufacturing galvannealed steel sheets according to claim 1, further comprising plating said coated strip with a top coating having an iron content of at least 50 % and a coating weight of at least 2 $g/m^2$.

* * * * *